United States Patent [19]

Tadema et al.

[11] 4,221,342

[45] Sep. 9, 1980

[54] DEVICE FOR PROCESSING RARE EARTHS

[75] Inventors: Jan C. Tadema, Bergen N. H., Netherlands; Hans-Günter Domazer, Essen-Stadtwald, Fed. Rep. of Germany

[73] Assignee: Wiener & Co. B.V., Amsterdam, Netherlands

[21] Appl. No.: 952,321

[22] Filed: Oct. 18, 1978

[30] Foreign Application Priority Data

Dec. 23, 1977 [NL] Netherlands ..... 7714387

[51] Int. Cl.[2] ..... B02C 17/00; B02C 23/24; B02C 23/34

[52] U.S. Cl. ..... 241/79; 241/171; 241/176; 241/DIG. 14

[58] Field of Search ..... 241/DIG. 14, 46.06, 241/46.15, 46.17, 68, 79, 171, 172, 173, 176

[56] References Cited

U.S. PATENT DOCUMENTS

| | | | |
|---|---|---|---|
| 1,793,098 | 2/1931 | Kramer | 241/DIG. 14 |
| 3,731,882 | 5/1973 | Muller et al. | 241/172 X |
| 3,887,142 | 6/1975 | McElvain | 241/171 X |

*Primary Examiner*—Richard B. Lazarus
*Attorney, Agent, or Firm*—John P. Snyder

[57] ABSTRACT

A device for processing rare earths with a grinding vessel having ball-shaped grinding bodies and an agitator for rotating the bodies, said vessel having a connection for the supply of liquid hexane andhaving near the bottom a tapping opening communicating with an evaporation vessel, said vessels having connections with a vacuum source and for the supply of rare gas, the evaporation vessel having an outlet for the ground product, and an outlet for the vaporlike products communicating with a condenser, the outlet of the condenser communicating through a control vessel and a hexane supply vessel with the inlet of the grinding vessel.

5 Claims, 2 Drawing Figures

Figures 1, 2:
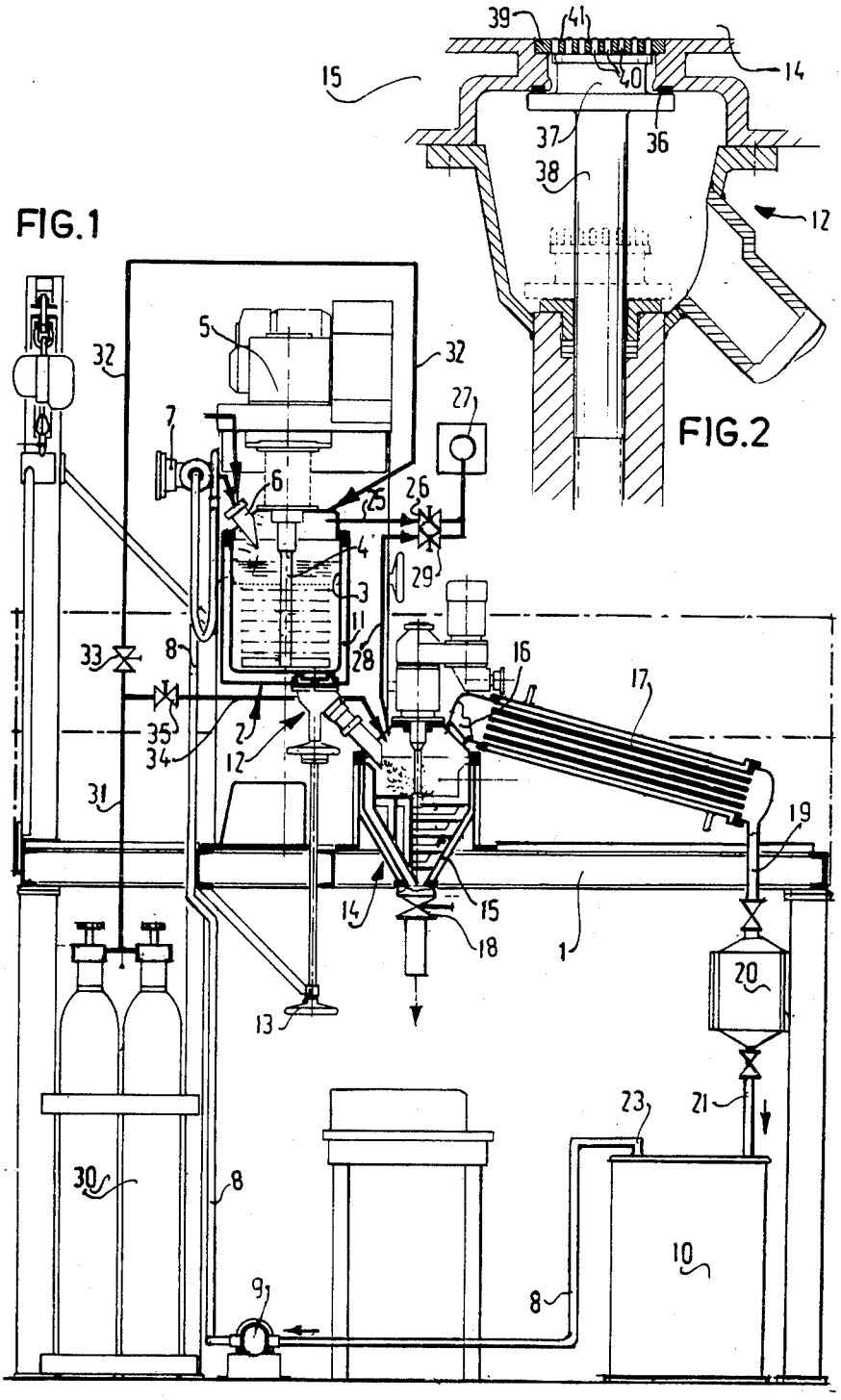

39
41
40
14
15
37
36
38
12
5
32
32
27
7
6
25
26
4
29
3
11
28
33
8
16
17
35
34
2
12
31
19
14
15
18
1
20
13
23
21
30
8
10
9
8

DEVICE FOR PROCESSING RARE EARTHS

The invention relates to a device for processing rare earths. Hitherto it has not been found possible to work rare earths in conventional grinding devices. The invention has for its object to provide a device which is, indeed, capable of doing so.

According to the invention such a device comprises a jacketed vessel having ball-shaped grinding bodies and an agitator for rotating the grinding bodies and the material to be ground, having an inlet for rare earths, a connection for the grinding vessel with a vacuum source, having a connection for the supply of a rare gas, particularly argon, having a connection for the supply of liquid hexane and having near the bottom side a tapping port provided with a sieve for the ground product and the hexane, said port communicating with an evaporation vessel provided with a heating jacket and having at the top a connection for a vacuum source, a connection for the supply of rare gas, particularly argon and an outlet for the vapour-like product communicating with a condenser and having on the bottom side an outlet for the ground product, the outlet of the condenser communicating with a control vessel, which communicates with a hexane storage vessel, an outlet of which communicates through a pump with an inlet of the grinding device. It is found that with the aid of such a device for the first time rare earths can be ground. It is important in this case to avoid the influence of oxygen, since this very adversely affects the grinding results. Owing to the use of vacuum and to the use of rare gas the influence of the oxygen from the open air is substantially eliminated. Apart therefrom, the rare earths themselves contain much oxygen and the influence of this oxygen is suppressed as far as possible by the use of the liquid hexane. With the closed circuit with the condenser for the hexane no hexane gets lost.

According to the invention a blocking device may be provided near the outlet port of the grinding device, said device comprising pins extending through the openings of the sieve. It is thus ensured that no dead spaces are found in the area of the sieve apertures.

According to the invention the grinding vessel and the collecting vessel may be provided with seals so that leakage is excluded and the vacuum can be satisfactorily maintained.

Finally in accordance with the invention the evaporation vessel may be provided with an agitator, which enhances the evaporation, whilst it is ensured that sufficiently pure hexane is available.

The invention will be described more fully hereinafter with reference to an embodiment shown in the drawing, in which FIG. 1 shows schematically a device in accordance with the invention, FIG. 2 shows on an enlarged scale and schematically the blocking device.

On a platform 1 is arranged a grinding device 2 comprising a vessel 3 containing a plurality of ball-shaped grinding bodies and accommodating an agitator 4, which can be driven by a motor 5. Around the shaft of the agitator 4 sealing material is provided for a seal against high pressure and vacuum. The inlet 6 serves for feeding in the material to be ground, in this case, the rare earth. Through a metering device 7 and a conduit 8 a pump 9 can feed in liquid hexane from a vessel 10. The vessel 3 is furthermore provided with a jacket 11. On the bottom side the vessel 3 communicates through an outlet device 12 actuated by a handwheel 13 with an evaporation vessel 14 provided with a heating jacket 15.

On the top side the evaporation vessel 14 has connection 16 for a condenser 17. On the bottom side an outlet 18 is provided for conducting the ground product away. The outlet of the condenser communicates at 19 with a control vessel 20, which communicates through a conduit 21 with a hexane stock vessel 10. The outlet of the vessel 10 communicates at 23 through a conduit 8 with the aforesaid pump 9, which can supply hexane through the conduit 8 to the grinding device 2. Reference numeral 27 designates a connection of a vacuum source (not shown). Through a conduit 25 and a closing member 26 the vacuum source communicates with the grinding vessel 3. In the same manner the evaporation vessel 14 communicates through a conduit 28 and a closing member 29 with the vacuum source. There is furthermore provided an argon supply vessel 30 communicating through a conduit 31 with a conduit 32 through a closing member 33. The conduit 32 communicates with the grinding vessel 3. The conduit 31 communicates furthermore with the conduit 34 through a closing member 35. The conduit 34 is connected with the evaporation vessel 14.

With the aid of the vacuum source and said conduit the device can first be exhausted to remove the oxygen. Owing to the argon conduits 31, 32 and 34 the grinding process can take place in an argon ambience. The oxygen released from the rare earths during grinding is absorbed by the liquid hexane.

FIG. 2 shows that the blocking device 12 is formed by a seat 36 in which a flap 37 is movable, said flap being actuated through the stem 38 by the handwheel 13. The outlet comprises a sieve plate 39. The flap 37 is provided with pins 40 extending in the apertures 41 of the sieve plate 39. When the flap is closed, the apertures are filled out by the pins 40 so that not any dead space is found in the area of the outlet.

What I claim is:

1. A device for processing rare earths characterized by a grinding device comprising a jacketed vessel having ball-shaped grinding bodies and an agitator for rotating the grinding bodies and the material to be ground, having an inlet for rare earths, having a connection for the communication of the grinding vessel with a vacuum source, having a connection for the supply of a rare gas, particularly argon, having a connection for the supply of liquid hexane and having near the bottom side a tapping opening provided with a sieve for the ground product and the hexane, said opening communicating with an evaporation vessel provided with a heating jacket and having on the top side a connection with a vacuum source, a connection for the supply of rare gas, particularly argon, and an outlet for the vapour-like product communicating with a condenser and on the bottom side an outlet for the ground product, whilst the outlet of the condenser communicates with a control vessel, which communicates with a hexane supply vessel, an outlet of which communicates through a pump with the inlet of the grinding device.

2. A device as claimed in claim 1 characterized in that near the outlet opening of the grinding device a blocking device is provided, which comprises pins extending through the apertures of the sieve.

3. A device as claimed in claim 1 or 2, characterized in that the grinding vessel and the collecting vessel are provided with seals.

4. A device as claimed in claim 3 characterized in that the evaporation vessel is provided with an agitator.

5. A device as claimed in claim 1 or 2 characterized in that the evaporation vessel is provided with an agitator.

* * * * *